US008348043B2

(12) United States Patent
Smith

(10) Patent No.: US 8,348,043 B2
(45) Date of Patent: Jan. 8, 2013

(54) APPARATUS HAVING A BILL VALIDATOR AND A METHOD OF SERVICING THE APPARATUS

(75) Inventor: Mike Smith, Scottsburg, IN (US)

(73) Assignee: Fire King Security Products, LLC, New Albany, IN (US)

( * ) Notice: Subject to any disclaimer, the term of this patent is extended or adjusted under 35 U.S.C. 154(b) by 1878 days.

(21) Appl. No.: 10/903,119

(22) Filed: Jul. 30, 2004

(65) Prior Publication Data

US 2006/0021848 A1 Feb. 2, 2006

(51) Int. Cl.
*G07F 9/10* (2006.01)

(52) U.S. Cl. ..... 194/350

(58) Field of Classification Search ..... 194/350, 194/202, 302, 344, 353; 312/321.5, 326
See application file for complete search history.

(56) References Cited

U.S. PATENT DOCUMENTS

| | | | | | |
|---|---|---|---|---|---|
| 5,438,855 | A * | 8/1995 | Ikeda | 70/279.1 |
| 5,544,728 | A * | 8/1996 | Dabrowski | 194/206 |
| 5,740,897 | A * | 4/1998 | Gauselmann | 194/206 |
| 5,742,034 | A | 4/1998 | Meeker | |
| 5,836,435 | A * | 11/1998 | Fujita et al. | 194/206 |
| 5,883,371 | A | 3/1999 | Meeker | |
| 5,890,439 | A | 4/1999 | McGunn | |
| 5,896,974 | A * | 4/1999 | Chang | 194/206 |
| 5,907,141 | A * | 5/1999 | Deaville et al. | 235/375 |
| 5,967,287 | A * | 10/1999 | Cole | 194/344 |
| 6,067,530 | A | 5/2000 | Brooks, Jr. et al. | |
| 6,276,603 | B1 | 8/2001 | Patterson | |
| 2002/0100399 | A1 * | 8/2002 | Young | 109/24.1 |
| 2004/0050650 | A1 * | 3/2004 | Yamagishi | 194/217 |
| 2005/0040005 | A1 * | 2/2005 | Dobbins | 194/206 |

* cited by examiner

*Primary Examiner* — Mark Beauchaine
(74) *Attorney, Agent, or Firm* — Brooks Kushman P.C.

(57) ABSTRACT

An apparatus having a bill validator. The apparatus having a storage area within a housing. The bill validator operable to input bills into the storage area. The bill validator being removable secured within the housing. The removable bill validator permitting the bill validator to be removed from the housing for servicing without comprising security of the storage area.

21 Claims, 3 Drawing Sheets

APPARATUS HAVING A BILL VALIDATOR AND A METHOD OF SERVICING THE APPARATUS

BACKGROUND OF THE INVENTION

1. Field of the Invention

The present invention relates to apparatuses having bill validators, such as safes, vending machines, and video game machines.

2. Background Art

A bill validator is an electro-mechanical device that processes bills. Typically, bills are inserted into the validator, processed, and delivered to a cassette or other item in a storage area of a safe or other item. In the past, the cassette and validator were located behind a security door. To access either item, the door must be unlocked.

The bills inputted into the validator may include dirt, grease, tape, and any variety of other particulate debris. The electro-mechanical nature of the validator and the debris carried by the bills renders it susceptible to malfunction. Typically, periodic servicing of the validator is needed to clean out such debris and/or to replace malfunctioning components. This servicing, however, can only be carried out if the security door is unlocked because the door must be opened to access to the validator.

The security of the items stored in the storage area is compromised each time the safe is unlocked. Owners of the items stored in the safe, therefore, desire the safe to remain locked at all times.

SUMMARY OF THE INVENTION

It is, therefore, an object of the present invention to provide an apparatus having a storage areas for storing valuables and a bill validator that permits the validator to be serviced without compromising the security of the stored items.

The present invention contemplates a number of features, including an apparatus having a housing and a storage area within the housing where items are stored for safekeeping. The apparatus can be a standalone device, such as a safe, or integrated into another structure, such as a vending machine, a video game machine, or the like.

The apparatus preferably includes a primary lock for controlling access to the storage area. The primary lock is operable to an unlocked position to permit access to the storage area. The apparatus further includes a bill validator for receiving bills and delivering the received bills to the storage area. The bill validator is removably secured within the housing such that the validator can be removed without unlocking the lock, such as for servicing.

The apparatus can further include a secondary lock for locking the validator in the housing such that the validator cannot be removed without unlocking the secondary lock. Preferably, the primary lock remains locked if the secondary lock is unlocked. The secondary lock can be a key-lock or an electric lock that is controllable by an electric controller.

The apparatus can further include a release mechanism for securing the bill validator within the housing. Preferably, the release mechanism is operable to a closed position to prevent removal of the bill validator and operable to an open position to permit removal of the bill validator. The release mechanism can be operated to the open position by pulling on an outward end of the bill validator or by pressing a lever of the release mechanism. The release mechanism can be operated to the closed position by loading the bill validator into the housing from a removed position.

The apparatus can further include a door configured for permitting access to the storage area. Preferably, the door is operable between an open position and a closed position, wherein the open position permits access to the storage area and the closed position prevents access to the storage area. The primary lock can be configured to lock the door in the closed position such that the primary lock is unlockable to permit access to the storage area through the opened door.

The apparatus can include a cassette in the storage area. Preferably, the cassette is in communication with the bill validator for storing bills inputting into the validator. The cassette can be removable secured within the storage area so that the cassette can be removed when the door is opened. The door can include a ledge extending rearwardly from the door into the housing to limit access to the cassette when the validator is removed from the housing.

One aspect of the present invention relates to a method for servicing a bill validator of a safe having a storage area containing a cassette being in communication with the bill validator to receive bills inputted into the bill validator, wherein the cassette is accessible by unlocking a primary lock. The method includes removing the bill validator from the safe for servicing without unlocking the primary lock.

The above features and advantages, along with other features and advantages of the present invention, are readily apparent from the following detailed description of the invention when taken in connection with the accompanying drawings.

DETAILED DESCRIPTION OF THE PREFERRED EMBODIMENT(S)

Figure 1:
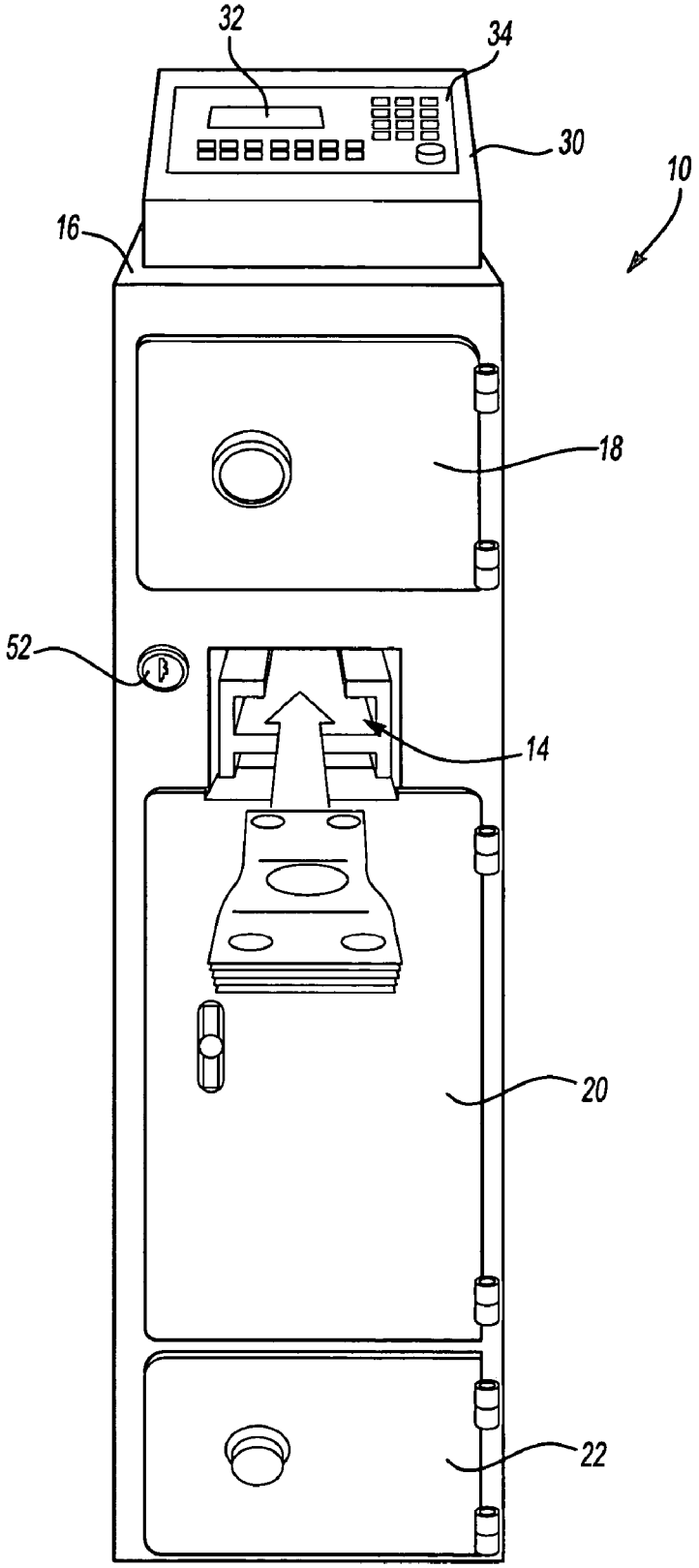
FIG. 1 illustrates a safe having a bill validator in accordance with one aspect of the present invention.

FIG. 1 illustrates a safe 10 having a bill validator 14 in accordance with one aspect of the present invention. The safe 10 includes a housing 16, a first door 18, a second door 20, and a third door 22. Behind each door 18, 20, and 22 valuable items can be stored within a storage area for safekeeping. The items stored therein can be removed by opening the respective door 18, 20, and 22.

The bill validator 14 is an electro-mechanical device that receives papers bills and processes them for storage in a storage area of the safe 10. As shown in FIG. 1, bills are fed into the bill validator 14 in the direction of the arrow; one or more bills can be inserted in this manner. The bills are then fed through the validator 14 for storage in the safe 10. Preferably, the bill validator 14 is a JCM validator that is commonly available from JCM American Corporation.

The safe 10 further includes a controller 30. The controller 30 includes a display 32 and a key-pad 34 having a number of keys for inputting information thereto. Preferably, the controller 30 controls opening and closing of the safe 10, such as by electrically controlling the unlocking and locking of the doors 18, 20, and 22 based on combination codes inputted into the controller 30. The controller 30 can be connected to a network or other communication medium to facilitate further control of the safe 10, including controlling and programming the operation thereof from remote locations.

The present invention contemplates a number of features for the safe 10 and is not intended to be limited to those shown in FIG. 1. Rather, the safe 10 can include more of less of theses features, and other features not described herein, without deviating from the scope and contemplation of the present invention. In particular, the present invention contemplates that the safe 10 included other features for operation in a video machine, vending machine, and the like.

Figure 2:
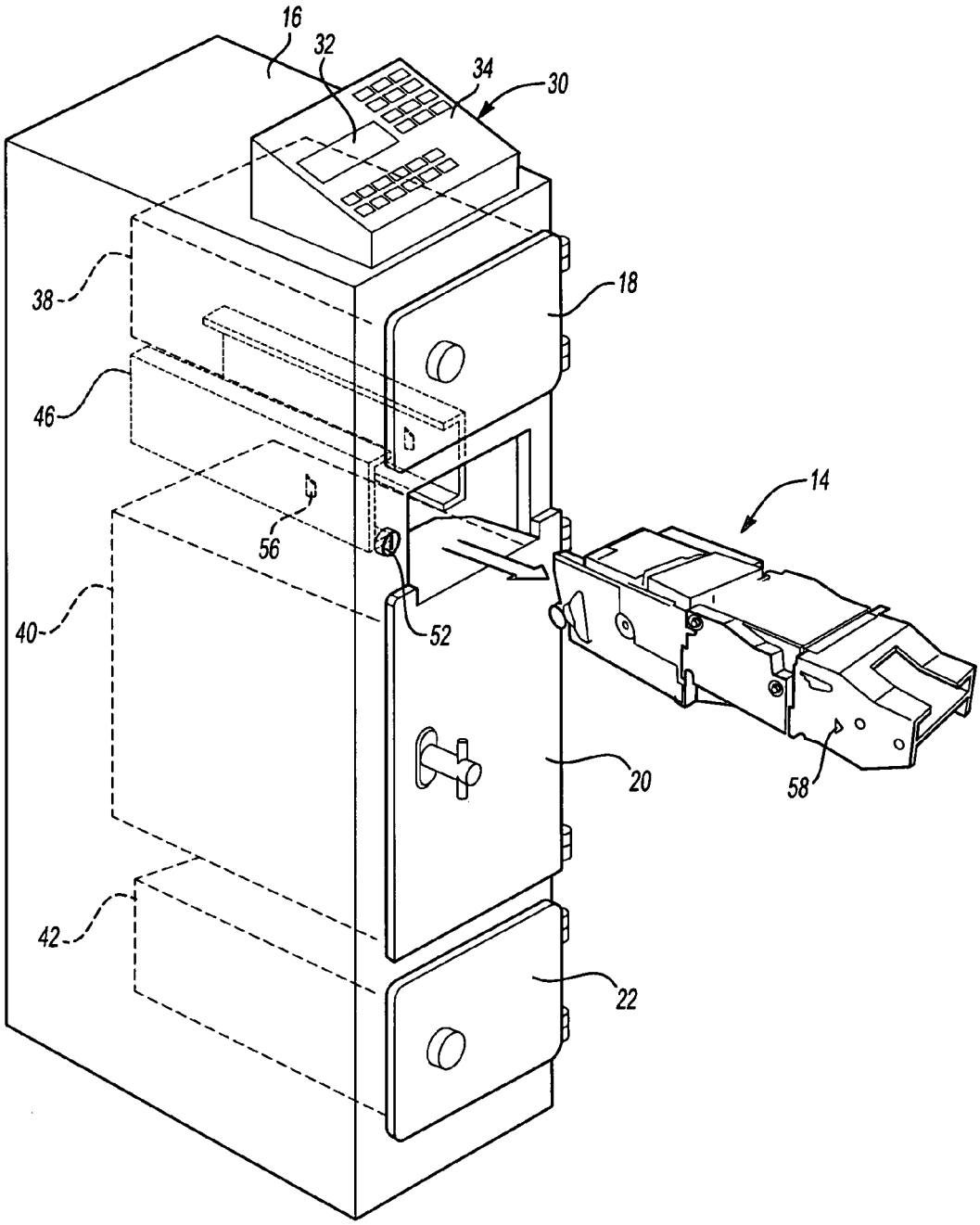
FIG. 2 illustrates a perspective view of the safe with a door closed in accordance with one aspect of the present invention.

FIG. 2 illustrates a perspective view of the safe 10 with the door 20 closed in accordance with one aspect of the present invention. As shown, the safe 10 includes a first cavity 38, a second cavity 40, and a third cavity 42 behind each of the first door 18, the second door 20, and the third door 22. These cavities 38, 40, and 42 can include any number of items, such as cassettes and the like, and/or can provide other areas for storing items. Preferably, each cavity 38, 40, and 42 is accessible by unlocking and opening its covering door.

In accordance with one aspect of the present invention, the bill validator 14 is removable secured within the safe 10. The validator 14 can be removed from the safe by pulling on its outward end in the direction of the arrow. A bracket 46 or other feature is included within the housing 16 for securing the validator 14 thereto. The various electro-mechanical elements, some of which are shown, are thereby accessible for servicing when the validator 14 is removed. Advantageously, this is done without requiring unlocking of any of the doors 18, 20, and 22.

A key-lock 52 can be included to secure the bill validator 14 within the safe 10 as a minimum security precaution. Likewise, an electronic lock (not shown) can operate in a similar manner and can be controlled by the controller 30 to lock the bill validator 14. Preferably, the key-lock 52 or electronic lock of the bill validator 14 has a key or key combination that is different from the locks on the doors 18, 20, and 22 such that one having access to the bill validator locks cannot open the doors 18, 20, and 22.

In the absence of the validator lock 52, or in addition thereto, a release mechanism comprising a pair of tabs 56 and a pair of detents 58 can be included on the bracket 52 and the validator 14. The release mechanism secures the validator 14 within the safe 10, such as to permit the validator to be tugged on without removing it from the safe. This can be helpful in preventing users from unintentionally disengaging the validator. If sufficient force is pulling on the validator 14, the tabs 56 release from the detents 58 and the release mechanism opens so that the validator 14 can be removed. From the removed position, the validator 14 is easily secured by simply inserting it back into the bracket 52 so that the tabs 56 and detents 58 catch.

Figure 3:
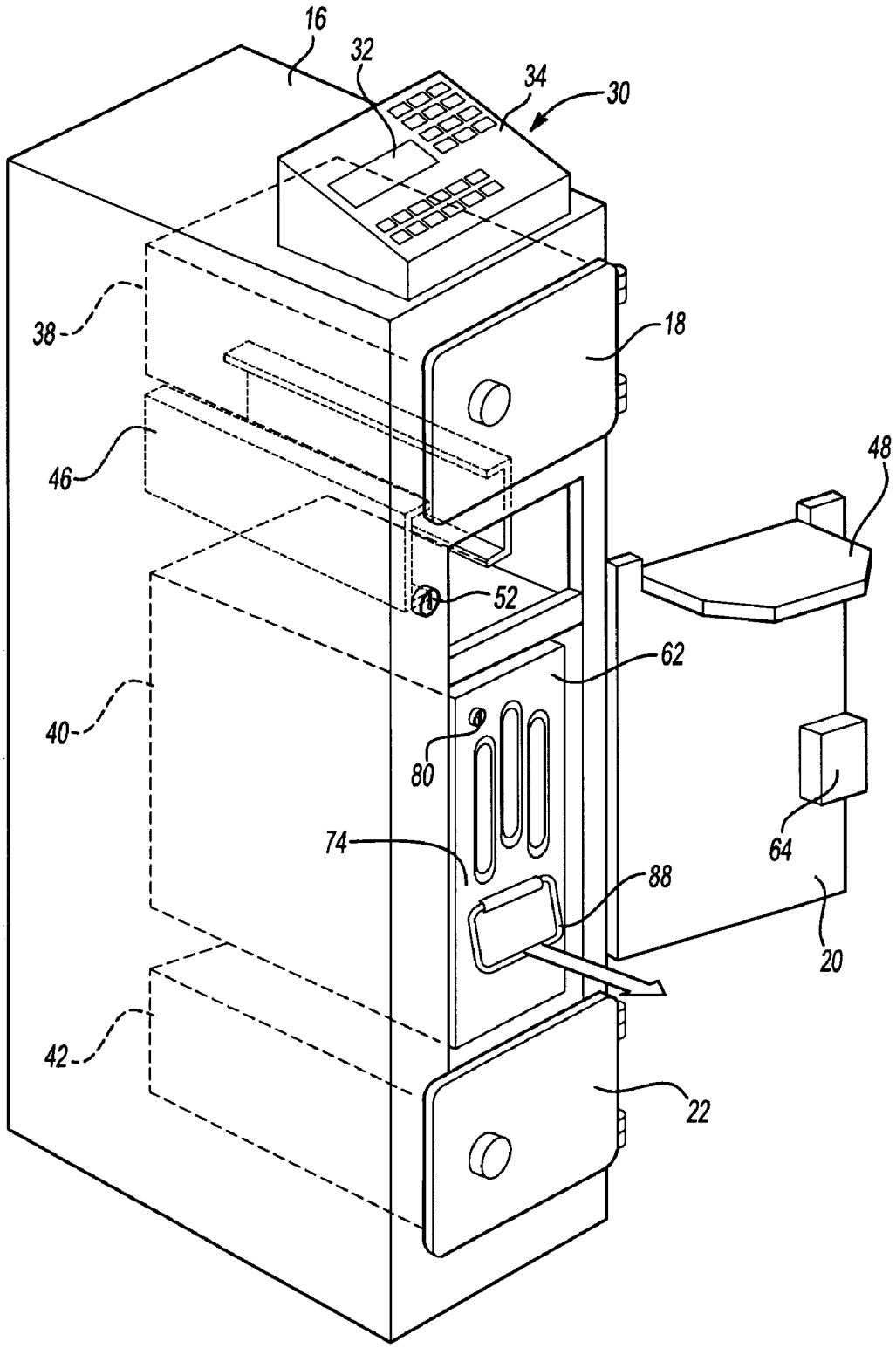
FIG. 3 illustrates a perspective view of the safe with the door open in accordance with one aspect of the present invention.

FIG. 3 illustrates a perspective view of the safe 10 with the door 20 open in accordance with one aspect of the present invention. As shown, the open door 20 reveals a cassette 62 and an electronic, or primary, lock 64. The cassette 62 is positioned below the bracket 46 for receiving the bills inserted into the bill validator 14, such as through an opening in the top of the cassette (not shown).

The cassette 62 preferably includes a handle 68 and a key-lock 70. The handle facilitates removal of the cassette 62 from the cavity 40 and the key-lock 70 locks a cover 74 of the cassette 62. The cassette 62 is a removable item that is only accessible by unlocking and opening the door 20. To further security of the cassette 62, the door 20 can include a ledge 78 that extends rearwardly from the door 20 into the safe 10. The ledge 78 provides an overhang for covering a portion of the cassette 62, thereby limiting access to the cassette 62 when the validator 14 is removed.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. In particular, the present invention contemplates the use of the removable bill validator 14 in other environments where it is desirable to permit removal of the bill validator 14, such as for servicing, without sacrificing the integrity of the items stored within the safe. One such environment contemplated by the present invention relates to vending machines and video games wherein money is stored in a cassette or similar item in a storage area.

What is claimed is:

1. An apparatus, the apparatus comprising:

a housing having a storage area wherein items are stored for safekeeping;

a primary lock for controlling access to the storage area, the primary lock being operable to an unlocked position to permit access to the storage area;

an exposed bill validator that is accessible for removal from outside the housing without unlocking a security lock, the bill validator being configured for receiving bills and delivering the received bills to the storage area, wherein the housing is configured to permit the validator to be removed without unlocking the primary lock and without providing access to items stored in the storage area.

2. The apparatus of claim 1 further including a release mechanism, the release mechanism securing the bill validator within the housing.

3. The apparatus of claim 2 wherein the release mechanism is operable to a closed position to prevent removal of the bill validator and operable to an open position to permit removal of the bill validator.

4. The apparatus of claim 3 wherein the release mechanism is operated to the open position by pulling on an outward end of the bill validator.

5. The apparatus of claim 3 wherein the release mechanism is operated to the closed position by loading the bill validator into the housing from a removed position.

6. The apparatus of claim 1 wherein the housing is a safe housing.

7. The apparatus of claim 1 further comprising a door being operable between an open position and a closed position, the open position permitting access to the storage area, the closed position preventing access to the storage area.

8. The apparatus of claim 7 wherein the primary lock is configured to lock the door in the closed position, and wherein the primary lock is unlockable to permit access to the storage area through the opened door.

9. The apparatus of claim 7 further comprising a cassette in the storage area, the cassette storing bills inputted into the validator.

10. The apparatus of claim 9 wherein the cassette is removably secured within the storage area, the cassette being removable when the door is open.

11. The apparatus of claim 9 wherein the door includes a ledge extending rearwardly from the door into the housing, the ledge limiting access to the cassette when the validator is removed from the housing.

12. An apparatus, the apparatus comprising:

a housing having a first opening and a second opening, the second opening permitting access to a storage area therein;

a door covering the second opening, the door being operable to an open position and a closed position;

a door lock for securing the door, the door lock being lockable for locking the door in the closed position, the door lock being unlockable for opening the door to the open position;

a cassette in the storage area, the cassette being removable secured within the storage area such that the cassette can be removed by operating the door to the open position;

a bill validator in the first opening, the bill validator configured to receive bills for inputting into the cassette, the bill validator being removable secured within the housing such that the bill validator can be removed for servicing without unlocking the door lock; and a ledge between the storage area and the bill validator to limit access to the storage area when the bill validator is removed.

13. The apparatus of claim 12 further including a release mechanism, the release mechanism securing the bill validator within the housing.

14. The apparatus of claim 13 wherein the release mechanism is operable to a closed position to prevent removal of the bill validator and operable to an open position to permit removal of the bill validator.

15. The apparatus of claim 13 wherein the release mechanism is operated to the open position by at least one of pulling on an outward end of the bill validator and pressing a lever of the release mechanism.

16. A method for servicing a bill validator of a safe having a storage area containing a cassette, the cassette in communication with the bill validator to receive bills inputted into the bill validator, the cassette being accessible by unlocking a primary lock, the method comprising:

removing the bill validator through an opening included on an outside non-moveable wall of the safe for servicing without performing any unlocking operations, including without unlocking the primary lock and without providing access to the cassette when the bill validator is removed, the validator being removable through the opening when the safe is locked.

17. A safe, the safe comprising:

a storage area secured behind a lockable door on a front side of the safe; and a bill validator proximate the front side of the safe for receiving paper bills, the bill validator being configured to deliver paper bills to the storage area, the bill validator being accessible and removable through an opening exposed on the front side of the safe when the safe is locked, the bill validator being accessible and removable without requiring unlocking of the door to the storage area.

18. The safe of claim 17 further comprising a bill validator lock for locking the bill validator within the safe, the bill validator lock being different from a door lock used with the lockable door such that the validator can be unlocked without unlocking the door lock.

19. The safe of claim 17 further comprising a cassette in the storage area for storing the paper bills received from the bill validator, wherein the bill validator is located above the door and the door includes a ledge extending rearwardly therefrom and under the bill validator, the ledge extending rearwardly to partially cover the cassette so as to limit access to the cassette when the bill validator is removed.

20. A safe comprising:

a housing having first and second openings, the first opening covered with a door behind which items are safely secured with a lock on the door, the second opening providing access to an exposed, unsecured and removable bill validator, the second opening located on a non-moveable outer wall of the safe and being larger than a width and height of the bill validator; and wherein the bill validator includes electrically driven, motorized features to facilitate electronically analyzing bills and delivering the analyzed bills to the storage area for safekeeping, the entire bill validator, including the electronically driven, motorized features, being unsecured and removable through the second opening.

21. The safe of claim 20 wherein the bill validator includes a transport system, the transport system being removable through the second opening when the safe is locked, wherein the lock on the door is the only security lock used to lock the safe.

* * * * *